US005947196A

United States Patent [19]

Halm et al.

[11] Patent Number: 5,947,196

[45] Date of Patent: Sep. 7, 1999

[54] HEAT EXCHANGER HAVING MANIFOLD FORMED OF STAMPED SHEET MATERIAL

[75] Inventors: Immanuel Halm, Seven Hills; Frank E. Tegel, Highland Heights, both of Ohio

[73] Assignee: S & Z Tool & Die Co., Inc., Cleveland, Ohio

[21] Appl. No.: 09/020,448

[22] Filed: Feb. 9, 1998

[51] Int. Cl.[6] ..... F28F 9/02

[52] U.S. Cl. ..... 165/173; 165/176; 165/148; 165/153; 165/175; 29/890.052; 29/890.053; 29/890.03

[58] Field of Search ..... 165/172, 173, 165/175, 176, 153, 148; 29/890.03, 890.052, 890.053

[56] References Cited

U.S. PATENT DOCUMENTS

| | | | |
|---|---|---|---|
| 4,945,635 | 8/1990 | Nobusue et al. . | |
| 5,052,478 | 10/1991 | Nakajima et al. | 165/153 |
| 5,082,051 | 1/1992 | Ando . | |
| 5,125,454 | 6/1992 | Creamer et al. | 165/173 |
| 5,172,762 | 12/1992 | Shinmura et al. | 165/173 |
| 5,214,847 | 6/1993 | Aoki . | |
| 5,586,600 | 12/1996 | Cribari | 165/173 |
| 5,649,588 | 7/1997 | Lee . | |
| 5,799,397 | 9/1998 | Yasuda et al. | 29/890.052 |
| 5,836,384 | 11/1998 | Wijkstrom et al. | 165/173 |
| 5,868,198 | 2/1999 | Kato | 165/153 |

*Primary Examiner*—Ira S. Lazarus
*Assistant Examiner*—Terrell McKinnon
*Attorney, Agent, or Firm*—Rankin, Hill, Porter & Clark LLP

[57] ABSTRACT

A heat exchanger includes a pair of manifolds, each of which has a plurality of axially spaced oblong slots. A plurality of generally flat tubes extends between the manifolds and individually through the slots for providing fluid communication between the manifolds. A plurality of radiation fins extends between adjacent flat tubes. At least one of the manifolds comprises a single formed rectangular sheet member having a seam formed from connection portions on each side edge of the sheet member. Each of the side edge connection portions includes an interlocking formation of tabs and recesses, at least some of the tabs deformed as the side edge connection portions engage each other in the circumferential direction. The interlocking formation provides an interconnection which is easier to form and after brazing less subject to burst when under pressure. End caps are provided on each end of the manifold, which include a concave shape which assists in holding the end caps in place when the manifold is pressurized. In addition, the manifold includes a two-piece bracket which is also formed of a flat sheet and which is mechanically attached to the manifold, and the manifold may include baffles which have grooves to assist in locating the baffles within the manifold.

16 Claims, 7 Drawing Sheets

HEAT EXCHANGER HAVING MANIFOLD FORMED OF STAMPED SHEET MATERIAL

BACKGROUND OF THE INVENTION

1. Field of the Invention

This invention relates to a heat exchanger for use as a condenser or evaporator for an air conditioner, a radiator or a heater core for a motor vehicle or to other types of heat exchangers, and more particularly, to the fabrication or manufacture of the manifold or header of the heat exchanger.

2. Description of the Prior Art

Heat exchangers generally include two cylindrical headers or manifolds which introduce a cooling medium into tubes and discharge it after it has circulated through the tubes. Heat exchangers of this type are used in automotive vehicles for several purposes, such as a radiator for cooling the engine and as a condenser for an air-conditioning coolant. The manifolds have often been formed each from a length of prefabricated pipe or from an extrusion and thereafter finished to incorporate a plurality of spaced slots along one side for connection to the cooling tubes. These manifolds also have end caps on each end and connections for the introduction of the cooling medium. After assembly of the heat exchanger components, the assembly is usually brazed in an oven to join the elements together as assembled and provide a sealed vessel for the cooling medium.

Instead of forming the manifolds from prefabricated pipe or from a tubular extrusion, several alternative designs have also been proposed for forming the manifolds by forming a flat plate or sheet material into a tube and attaching the side edges together to achieve a tubular shape. One problem of this approach is that the side edge connection is often unreliable and unable to withstand the pressures experienced during operation of the heat exchanger. The side edge connection is particularly prone to burst under pressures at or slightly above normal operating pressures when the heat exchanger is used as a condenser.

Several schemes have been proposed to improve this connection in order to improve the burst strength of the manifold.

U.S. Pat. No. 4,945,635 issued to Nobusue et al. forms the manifold from a brazing sheet rolled into a tube and connected along its longitudinal edge by the brazing operation. Such a connection lacks the inherent strength needed in many heat exchanger applications.

U.S. Pat. No. 5,172,762, issued to Shimura et al. forms the manifold header by bending a longitudinal flat plate into a pipe shape and connecting the side edge portions together with a longitudinally extending groove and raised tab. This side edge connection requires that the side edges be distorted radially in order for the groove to fit over the tab, complicating the fabrication of the manifold.

U.S. Pat. No. 5,214,847, issued to Aoki, also forms the header from a plate, and connects the side edges of the plate together by providing the seam between the side edges where the cooling tubes join the header, and by engaging the tubes and using the engagement to provide a fiction fit. While this arrangement provides a stronger connection than the previously discussed arrangements, the friction fit still has limited strength when the heat exchanger is used as a condenser and the heat exchanger is exposed to higher pressures.

U.S. Pat. No. 5,649,588, issued to Lee, provides a condenser which has a manifolds or headers formed of a flat sheet of metal formed into a tube. The side edges are formed into flanges which are welded together, and the flanges also provide the mounting bracket for the condenser. The welding involves an additional step in the formation of the header or manifold which adds to its expense.

Another prior art design forms the manifold header from a sheet or plate and connects the side edges together with an interlocking design that involves tongues on one side edge which fit into corresponding recesses on the other side edge. The tongues are of the design similar to those used in jigsaw puzzles, so that radial movement of one of the side edges is required to interlock the side edges. This radial movement is difficult to achieve in many forming operations, which adds to the complexity and expense of the fabrication of the header.

SUMMARY OF THE INVENTION

The present invention overcomes the disadvantages of the prior art and provides a heat exchanger having manifolds formed of sheet material having increased burst strength. In accordance with the present invention, the manifold is formed of a brazing sheet formed into a tube with the side edges connected together by the connection of a unique interlocking formation on each side of the sheet. The connection provides a strong mechanical interlocking bond between the sides of the sheet, resulting in increased strength and reducing the likelihood of bursting when the manifold is pressurized.

Unlike the prior art, the present invention uses a circumferentially engaging interlocking formation. This interlocking formation design is relatively easy and inexpensive to fabricate, and permits the formation of the tube through circumferentially engagement of the side edges of the sheet, without the need for any forming of the sheet in the radial direction. The interlocking mechanism of the present invention also involves a deformation of the interlocking tabs, and is less likely to come apart under pressure. Once assembled, the interlocking formation cannot be pulled apart without another deformation process. Therefore, the force by which the manifold is assembled results in a stronger interlocking seam, which is more difficult to pull apart and more resistant to burst.

Since the interlocking mechanism of the present invention can be assembled with the sides of the sheet engaging each other entirely in the circumferential direction, the manifold of this invention can be more easily made by utilizing a progressive die operation. The interlocking mechanism does not require radial movement of the side edges of the sheet material, which would complicate the assembly process and make the manifold more difficult and expensive to assemble. Because the sheet sides interlock circumferentially, the fabrication of the manifold can be readily formed by a conventional forming process, avoiding the need for more complicated and commercially unfeasible forming operations.

The present invention also includes a unique bracket which is used to mount the manifold, and thus mount the heat exchanger to the vehicle. The preferred bracket is also made of a flat brazing sheet, and is preferably formed of two corresponding members which fit around the manifold to hold the manifold in place. The two members are mechanically attached together, preferably by the formation of tabs on the periphery of the flange of one of the members which tabs are cammed or coined over the edges of the flange of the other member to hold the members together. Alternatively, a mechanical connection can be formed at the holes which are also used to mount the heat exchanger.

The heat exchanger of the present invention also uses baffles or end caps in the manifold which include a unique concave shape which assists in holding the end caps in place on manifold when the manifold is pressurized. The baffles or end caps may also include circumferential grooves which can be used to crimp the outside of the manifold to hold the baffles in place during the assembly process until the entire assembly is subsequently brazed.

The present invention thus provides a unique combination of features not present in the prior art and which together provide a heat exchanger having a manifold which is easier to assemble and ultimately stronger than those of the prior art.

These and other advantages are provided by the present invention of a heat exchanger comprising a pair of manifolds. Each of the manifolds has a plurality of axially spaced oblong slots. A plurality of generally flat tubes extends between the manifolds and individually through the slots for providing fluid communication between the manifolds. A plurality of radiation fins extends between adjacent flat tubes. At least one of the manifolds comprises a single formed rectangular sheet member having a seam formed from connection portions on each side edge of the sheet member. Each of the side edge connection portions includes an interlocking formation of tabs and recesses, at least some of the tabs deformed as the side edge connection portions engage each other in the circumferential direction.

DETAILED DESCRIPTION OF THE PREFERRED EMBODIMENT

Figure 1:
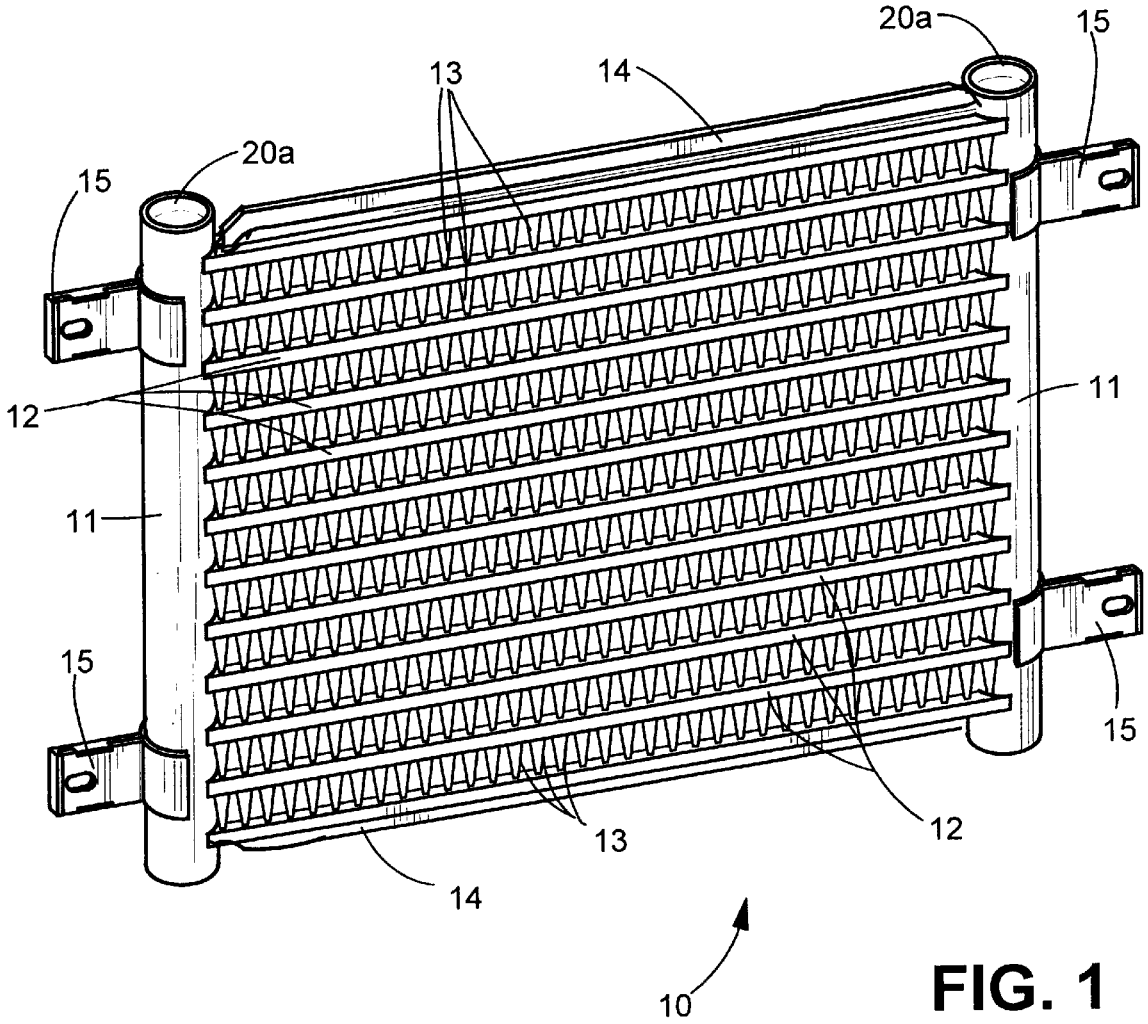
FIG. 1 is a perspective view of a heat exchanger according to the present invention.

Referring more particularly to the drawings and initially to FIG. 1, there is shown a heat exchanger 10 according to the present invention. The preferred heat exchanger may be, for example, a condenser used in the air-conditioning system of an automobile, truck or other similar motor vehicle. The heat exchanger 10 includes a pair of manifolds 11 extending parallel to each other, with a plurality of cooling tubes 12 disposed between the manifolds and connected at each end to the manifolds. The manifolds 11 have a connection (not shown) for the introduction of a cooling medium into the heat exchanger. A plurality of radiation fins 13 is provided on the sides of the tubes 12, and a pair of reinforcement members 14 may be provided on the top and bottom of the radiation fins. The heat exchanger 10 is mounted in the vehicle or other location by means of brackets 15.

Figure 2:
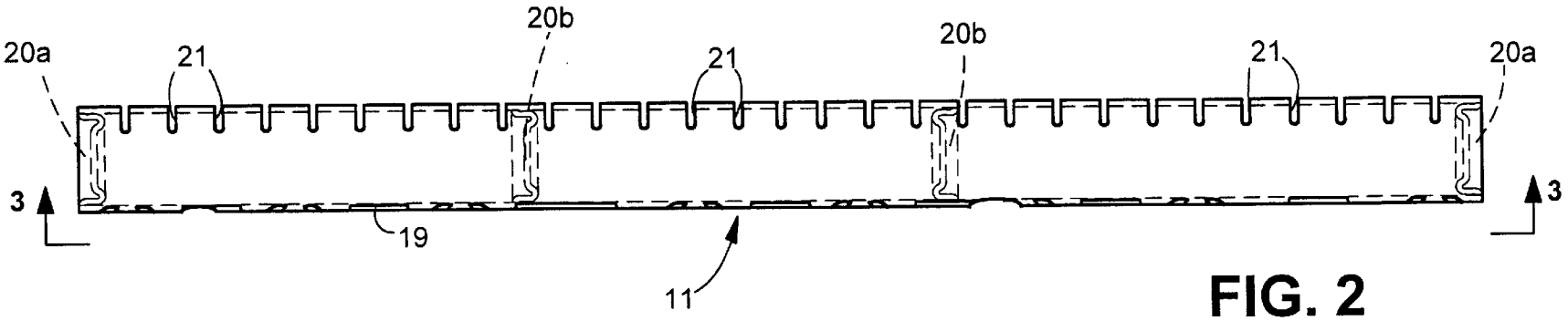
FIG. 2 is an elevational view of one of the manifolds of the heat exchanger of FIG. 1.
Figure 3:
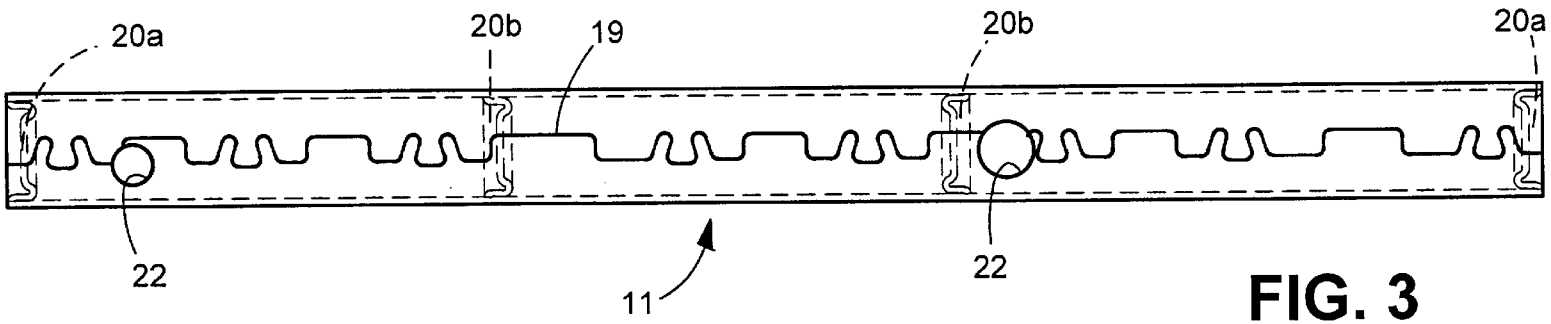
FIG. 3 is another elevational view of the manifold taken along line 3—3 of FIG. 2.
Figure 4:
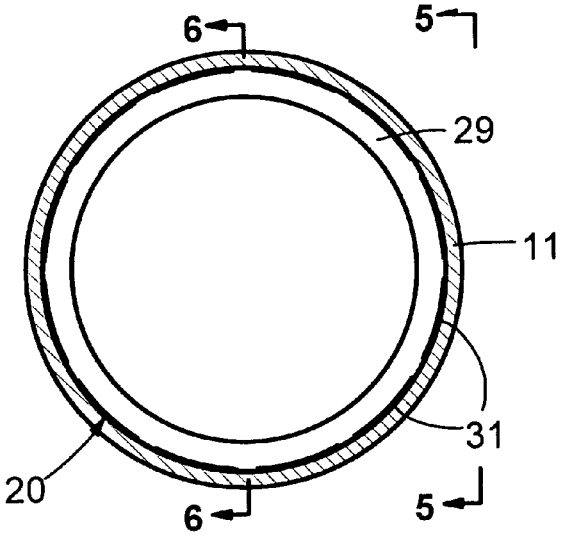
FIG. 4 is an end sectional view of a portion of the manifold of FIGS. 2 and 3 showing one of the baffles or end caps.

The manifold 11 is shown in more detail in FIGS. 2 and 3. The manifold 11 comprises a metal sheet formed into a tubular form with its sides joined together in a seam 19 to form a manifold tube. The seam 19 is generally zig-zag in shape because it is formed by a mechanical interlock which will be explained in detail below. A cap 20*a* is located on each end of the manifold 11 to enclose the manifold. The tube has a plurality of slots 21 along one side for connection to cooling tubes 12. A plurality of holes 22 are provided along the opposite side for the connection of a fitting which is used to introduce the cooling medium into the manifold, and a plurality of baffles 20*b* are mounted inside the manifold to divide the manifold into chambers to equalize the flow of cooling medium through the manifold.

Figure 5:
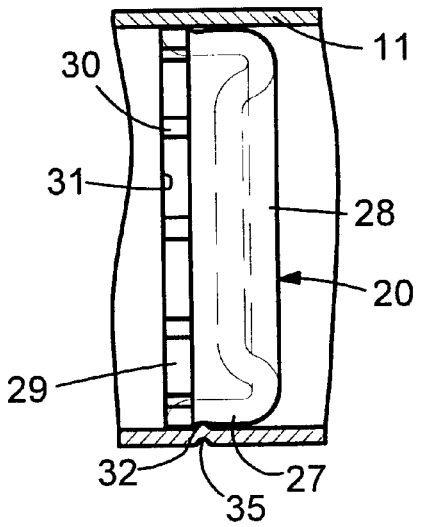
FIG. 5 is a side elevational view of the baffle or end cap taken along line 5—5 of FIG. 4.
Figure 6:
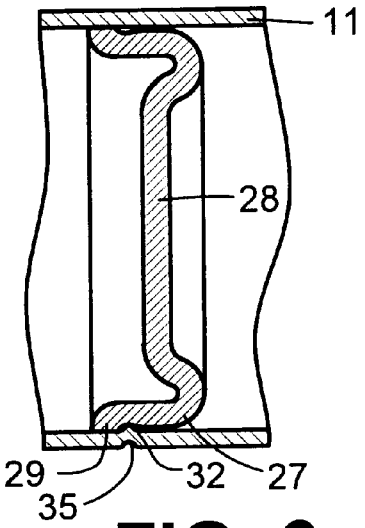
FIG. 6 is a sectional view of the baffle or end cap taken along line 6—6 of FIG. 4.
Figure 7:
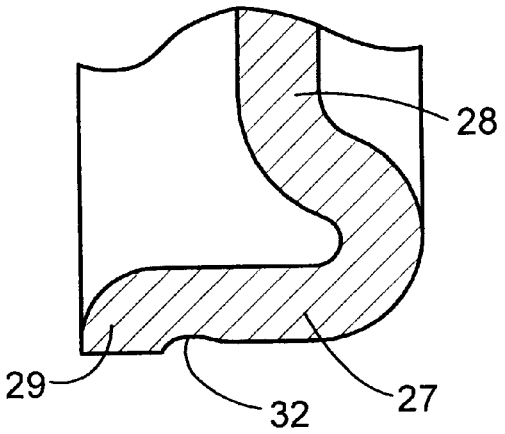
FIG. 7 is a detailed enlarged view of a portion of FIG. 6 showing the groove on the baffle or end cap.
Figure 8:
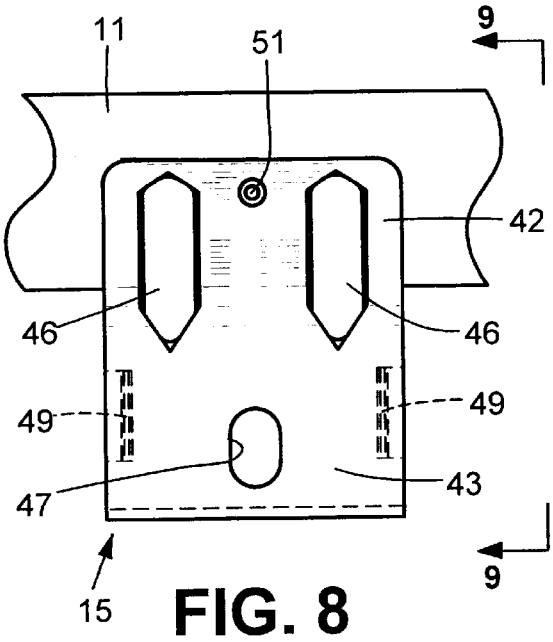
FIG. 8 is a side elevational view of a portion of the assembled manifold showing one embodiment of the bracket.

The end caps 20*a* and the baffles 20*b* may be substantially identical, and are preferably of the construction of the baffle member 20 shown in FIGS. 4–7. The baffle member 20 includes is generally cup shaped with outer side portions 27 and an end portion 28. The outer side portions 27 of the baffle member are intended to fit circumferentially along the inside surface of the manifold 11, and the end portion 28 is intended to extend radially across the inside of the manifold to block the flow of the medium in the manifold. At one end of the side portions 27 is an outer rim 29 which also fits against the inside surface of the manifold 11. The outer rim 29 is preferably provided with a series of raised portions 30 which in between them define recesses or channels 31 around the outer surface of the rim and extending parallel to the longitudinal axis of the tubular manifold. The channels 31 provide a path for flux to flow past the position of the baffle position during the brazing process. A groove 32 extends circumferentially around the baffle side portions 27 adjacent to the outer rim 29. The central portion of the end portion 28 is concave in shape when viewed from end of the baffle member opposite the rim 29 (when viewed from the right side as shown in FIGS. 5 and 6).

When the baffle member 20 is installed in the manifold, and especially when it is used as one of the end caps 20*a*, the concave end portion 28 assists in holding the baffle or end cap in place. When placed on the end of tubular manifold 11 with the concave end portion 28 facing the inside of the manifold, the pressure of the medium inside the manifold presses against the concave end portion 28, tending to increase the concavity which, in turn, causes the side portions 27 of the end cap to deform radially outwardly. Thus the pressure of the medium in the manifold is used to apply further force by the sides of the end cap upon the interior sidewalls of the manifold, helping the secure the end cap in place.

The groove 32 is used to locate and mount the baffle members 20 in place in the assembly process. When the baffle member 20 is used as one of the baffles 20*b*inside the manifold 11, it may be difficult to identify the location of the baffle and assure that it is properly located prior to brazing. During the assembly process, as will be explained more fully below, one or more crimps 35 may be placed in the outside of the manifold 11 at the position of the baffle 20*b*, and the crimps 35 will deform the manifold slightly to force a portion of the inside surface of the manifold into a portion of the groove 32. This serves to hold the baffle 20*b* in place during subsequent assembly and processing until the brazing operation is performed to secure the baffle. It also provides a visual indication on the outside of the manifold 11 of the position of the baffle 20*b*, which would otherwise be impossible to locate because it is completely hidden after the manifold has been assembled.

An example of one of the brackets 15 are shown in more detail in FIGS. 8–11. The bracket 15 is comprised of a first member 40 and a second member 41. The first bracket member 40, shown in the left in FIG. 10, includes a curved portion 42 which extends circumferentially around a portion of the outside of the manifold 11, and a flange portion 43 which is substantially flat and extends from the curved portion. The second bracket member 41, shown on the right in FIG. 10, also has a curved portion 44 which extends circumferentially around a portion of the outside of the manifold 11, and a flange portion 45 which is substantially flat and extends from the curved portion. The curved portions each have ribs 46 extending circumferentially along the curved portions to provide structural support to the bracket 15.

Figure 11:
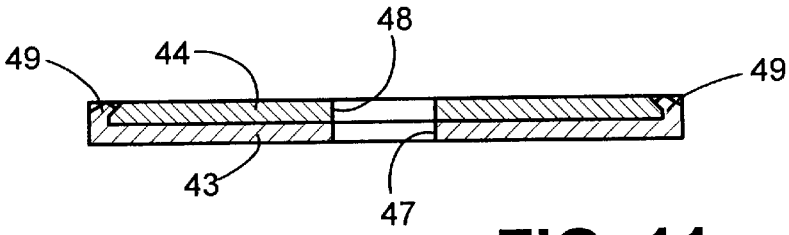
FIG. 11 is a sectional view taken along line 11—11 of FIG. 9.

The flange portions 43 and 45 extend in juxtaposition with each other to form together the mounting flange of the bracket 15. Concentric holes 47 and 48 are formed in each of the flange portions for using the bracket 15 to mount the heat exchanger, such as by nut and bolt, or other suitable fastener. The flange portions 43 and 45 are affixed to each other, preferably by a mechanical interlock formed by tabs 49 which are formed around the periphery of the flange portion 43. As shown in FIG. 11, the tabs 49 are coined over the periphery of the flange portion 45 of the second bracket member 41 to secure the flange portions 43 and 45 together, and thus secure the bracket members 40 and 41.

The first bracket member 40 also has at least one protrusion 51 extending inwardly on the curved portion 42. A corresponding detent or hole is formed or punched on the manifold at the desired position of the bracket 15. When the bracket 15 is mounted onto the manifold 11, the protrusion 51 is positioned in the corresponding detent or hole formed on the exterior side of the manifold. The correspondence of the protrusion 51 and the corresponding detent or hole in the manifold provides a means by which the bracket is held in position on the manifold during the initial assembly process until it is securely fixed together by the subsequent brazing process.

Figure 12:
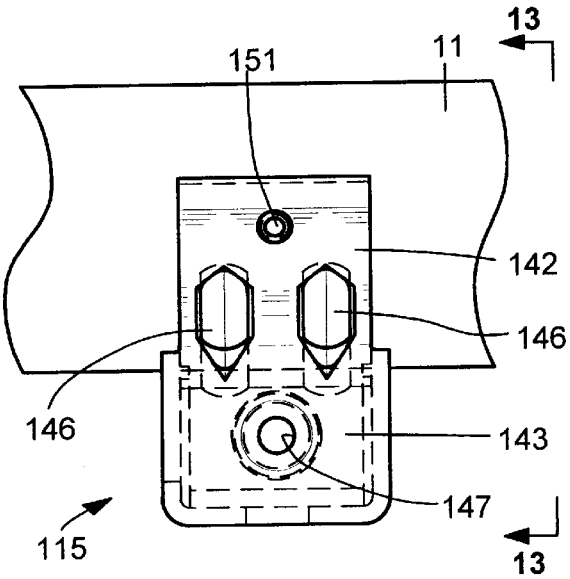
FIG. 12 is a side elevational view of a portion of the assembled manifold similar to FIG. 8 showing another embodiment of the bracket.
Figure 13:
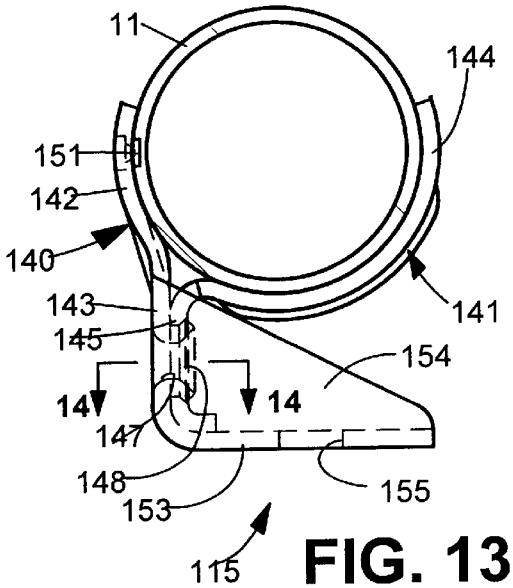
FIG. 13 is an end sectional view taken along line 13—13 of FIG. 12.
Figure 14:
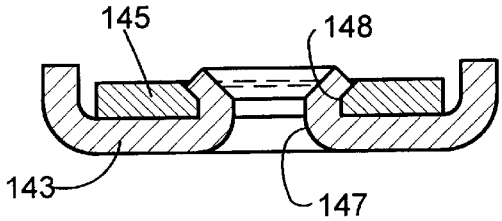
FIG. 14 is a sectional view taken along line 14—14 of FIG. 13.

Another example of one of the brackets is shown as the bracket 115 in FIGS. 12–14. The bracket 115 is also comprised of a first member 140 and a second member 141. The first bracket member 140 includes a curved portion 142 which extends circumferentially around a portion of the outside of the manifold 11, and a flange portion 143 which is substantially flat and extends from the curved portion. The second bracket member 41 also has a curved portion 144 which extends circumferentially around a portion of the outside of the manifold 11, and a flange portion 145 which is substantially flat and extends from the curved portion. The curved portions each have ribs 146 extending circumferentially along the curved.

The flange portions 143 and 145 extend in juxtaposition with each other to form together the mounting flange of the bracket 115. The flange portions 143 and 145 are affixed to each other by a different mechanical interlock formed by concentric holes 147 and 148 formed in each of the flange portions. As shown in FIG. 14, the rim around the hole 147 in the first bracket member is coined over the rim around the hole 148 in the second bracket member to secure the flange portions 143 and 145 together, and thus secure the bracket members 140 and 141. At the same time, the interlock provides a hole 147, 148 by which the bracket can be used for mounting the heat exchanger, such as by nut and bolt, or other suitable fastener.

The first bracket member 140 also has at least one protrusion 151 extending inwardly on the curved portion 142 which fits into a corresponding detent or hole is formed on the manifold at the desired position of the bracket 115. When the bracket 115 is mounted onto the manifold 11, the protrusion 151 is positioned in the corresponding detent or hole formed on the exterior side of the manifold.

As shown in FIG. 13, the end of the flange portion 143 may be bent to extend orthogonally to provide a perpendicular portion 153 which is used to position the heat exchanger when the bracket 115 is used to mount the heat exchanger or to provide an additional mounting flange extending in the perpendicular direction. The perpendicular portion 153 may be formed with a pair of wings 154, one extending from each side of the perpendicular portion 153 and extending to the flange portion 143 when the bracket portion is assembled to support the perpendicular portion 53. The perpendicular portion 153 may include an additional hole 155 which also can be used to mount the heat exchanger. While the bracket shown in FIGS. 12 and 13 includes the perpendicular flange portion 153, the entire flange can also be made straight as with the bracket 15 or in any other desirable shape as required for the mounting of the heat exchanger.

Figure 9:
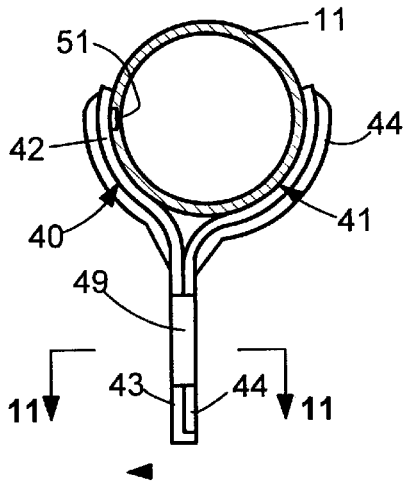
FIG. 9 is an end sectional view taken along line 9—9 of FIG. 8.
Figure 10:
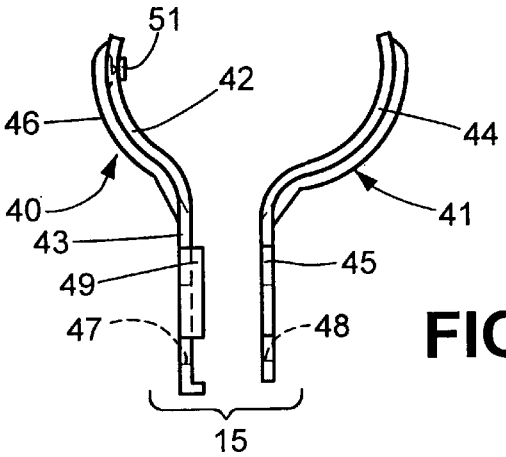
FIG. 10 is a end elevational view of the bracket similar to FIG. 9 showing the two bracket members separated.

In addition, while the bracket 115 shown in FIGS. 12 and 13 includes curved portions 142 and 144 in which the curved portion 142 is more circumferentially extensive than the curved portion 144, the curved portions 142 and 144 can be made equally circumferentially extensive (so that the flange portions 143 and 145 extend generally radially from the manifold 11, similar to the flange portions 43 and 45 of the bracket 15 of FIG. 9), or the curved portion 142 can be made more circumferentially extensive than the curved portion 144. The circumferential extent of the curved portions 42 and 44, or 142 and 144, and thus the location at which the flange portions 43 and 45, or 143 and 145, extend from the manifold 11 can be appropriately modified as necessary depending the upon the mounting arrangement for the heat exchanger. However, the curved portions 42 and 44, or 142 and 144, together should define a circular cross section which is significantly greater than 180° so that the manifold 11 is effectively captured between the curved portions and the manifold is held in place when the bracket members are secured togther. The curved portions should extend as far as possible around the manifold 11, but not so far as to be too close to the tubes 12 extending from the slots 21 on the other side of the manifold, since the bracket 15 could provide an undesirable heat sink for the heat from the tubes 12 and fins 13.

As previously mentioned, the manifold 11 is made of a formed sheet material, the sides of the sheet are joined together at the seam 19 by an interlocking formation which will be explained in more detail with reference to the assembly of the manifold.

Figure 15:
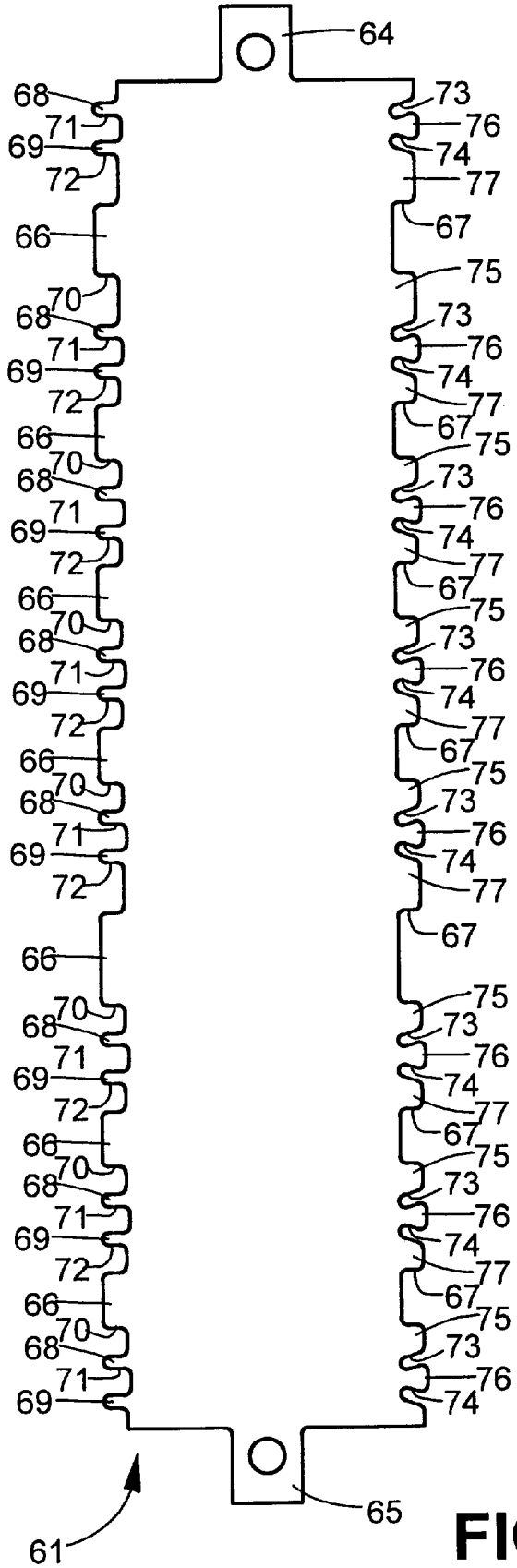
FIG. 15 is an elevational view of a sheet used to form the manifold of FIGS. 2 and 3.

In making the heat exchanger assembly of the present invention, a brazing sheet 61 is prepared from an aluminum core sheet with a brazing substance on at least one surface. The sheet 61 is then formed into the manifold 11, preferably using a progressive die operation. The sheet 61 is first stamped or otherwise formed into the configuration shown in FIG. 15 in which a series of tabs and recesses is stamped on each side of the sheet. Preferably, locator tabs 64 and 65 are also stamped on each end of the sheet 61 to provide a carrier for pilot holes which assist in locating the sheet at each station in the progressive die operation. The tabs and recesses on the sides of the sheet 61 form the interlocking formation which provides a mechanism which holds the sides of the sheet together to form the tubular manifold. The tabs include a plurality of positioning tabs 66 on one side of the sheet 61 (on the left side as shown in FIG. 15) which engage corresponding positioning recesses 67 on the other side of the sheet (on the right side as shown in FIG. 15). Between the positioning tabs 66 on the first side of the sheet 61 are two interlocking tabs 68 and 69 defined and separated by recesses 70, 71 and 72. On the opposite side of the sheet 61 between the positioning recesses 67 are two corresponding interlocking recesses 73 and 74 defined by tabs 75, 76 and 77. While the interlocking tabs 68 and 69 extend generally perpendicular to the sides of the sheet 61, the corresponding interlocking recesses 73 and 74 extend at an angle relative to the direction of the interlocking tabs 68 and 69. This angle may be between 5° and 45°, and it is preferably about 18°. The angle of the interlocking recesses 73 and 74 causes the interlocking tabs 68 and 69 to be deformed as the tabs are forced into the recesses during the forming operation, causing a secure mechanical attachment between the sides of the sheet, as will be explained in more detail below.

Figure 16:
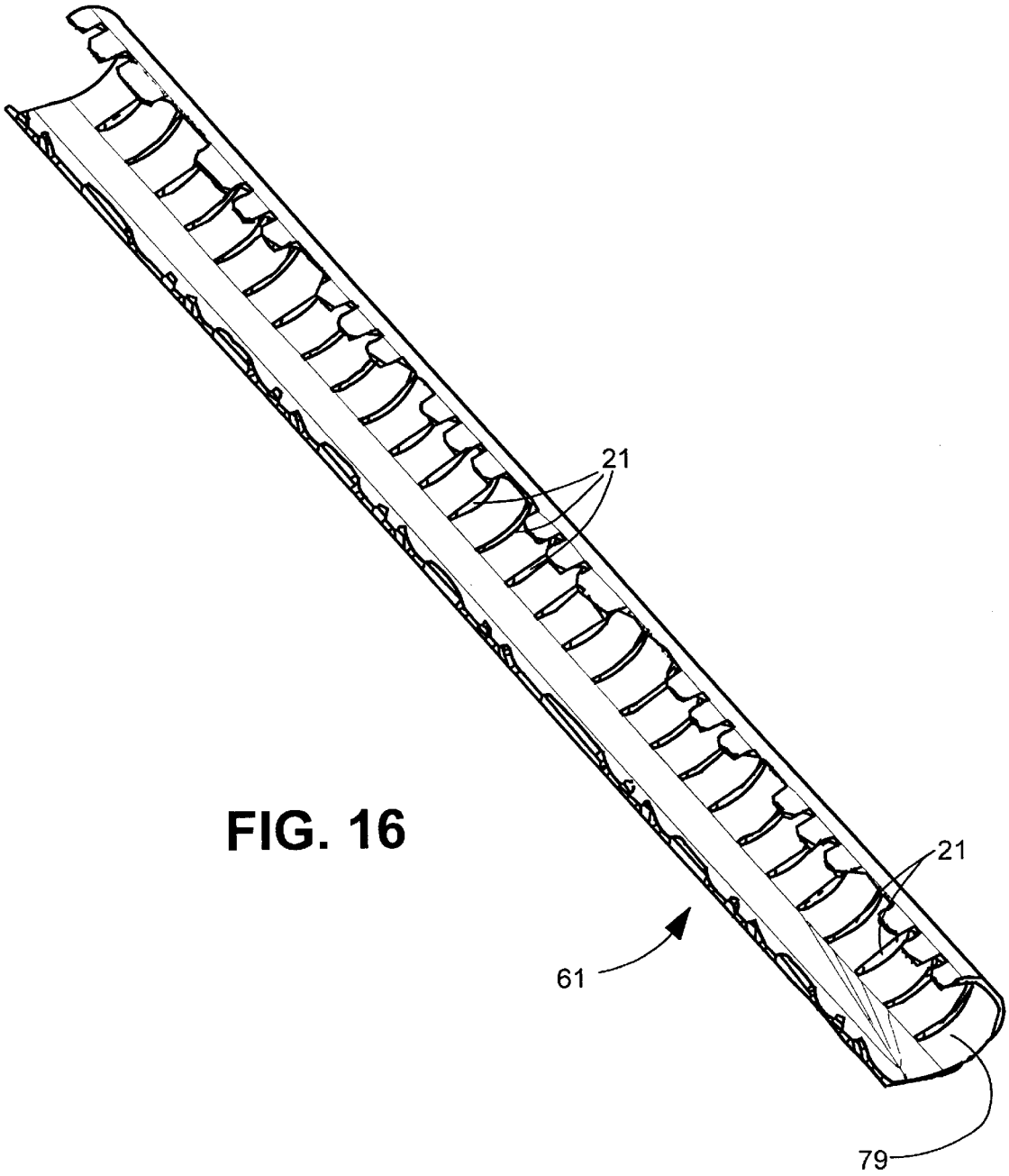
FIG. 16 is a perspective view of the sheet of FIG. 11 partially formed into the manifold.

In a sequential progression of stamping and forming operations, the manifold develops into its tubular shape. First, the sheet 61 is formed into a semi-tubular shape, such that the middle portion 79 of the sheet is curved as shown in FIG. 16. The sheet 61 is then conveyed to a station in the progressive die operation in which the slots 21 are pierced or punched through the sheet. The pilot holes formed in the locator tabs 64 and 65 are used to assist in positioning the sheet at this station so that the slots are punched through the sheet at the precise desired locations. The slots 21 are formed with the middle portion 79 of the sheet already in a curved condition which approximates the final curved shape for this portion of the sheet. As a result, the slots 21 are formed with their side walls at the proper angle for the insertion of the ends of the tubes 12 into the finished tubular manifold. If the slots 21 were pierced or punched while the sheet 61 was entirely flat, the subsequent tubular forming operation would cause the shape of the slots to deform, making it more difficult to insert the tubes during the assembly operation. Also, the slots 21 are punched through the material from the inside of the manifold toward the outside, so that any residual material from the punching operation is formed on the outside of the manifold, not on the inside where it could contaminate the cooling medium and degrade the performance of the heat exchanger.

After punching the slots 21, the sheet is further formed into its finished tubular shape. As the sheet is formed in this second forming operation, the sides of the sheet come together in a circumferential direction, and the positioning tabs 66 engage the positioning recesses 67 so that the other tabs and recesses are properly oriented with respect to each other. As the sides of the sheet come together, the interlocking tabs 68 and 69 are forced into the angled interlocking recesses 73 and 74. As the interlocking tabs 68 and 69 engage the interlocking recesses 73 and 74, each interlocking tab is forced to deform to fit the angle of the interlocking recess. Since the interlocking tabs 68 and 69 are much narrower than the tabs 75, 76 and 77 on the opposite side of the sheet which form the interlocking recesses 73 and 74, the interlocking tabs 68 and 69 will deform before the tabs 75, 76 and 77 deform, and the interlocking tabs 68 and 69 are forced to assume the shape of the interlocking recess 73 and 74 into which there driven. Once the interlocking tabs 68 and 69 are so deformed, each pair of tabs is pinched together, and they are incapable of removal from the interlocking recesses 73 and 74 in the circumferential direction. A secure interlocking engagement is formed between the sides of the sheet, and the resulting tubular shape is secure from being forced part even at relatively high pressures.

It is noted that this interlocking operation occurs as the tabs and recesses on the sides of the sheet approach each other in the circumferential direction. No deformation of the sheet 61 in the radial direction is required in order to engage the interlocking mechanism. In this manner the interlocking mechanism can be put together in a conventional progressive die operation without the need for a more complicated deformation of the sheet material which would be commercially unfeasible. Furthermore, since the tabs are deformed by the interlocking operation, they are less likely to come apart when exposed to high pressures.

After the manifold 11 has been formed, the baffles **20*b* are inserted into the tubular manifold and located at their desired positions. Then crimps 35 are formed on the outside of the manifold 11 at the location of the baffle groove 32 to hold the baffle 20*b* in place and to provide a visual indication of the presence and position of the baffle. The end caps 20*a* are then attached at each end of the manifold 11** in a similar manner.

The brackets 15 are formed in two pieces as previously discussed. Each bracket member 40 and 41 is made of a brazing sheet, comprising a core aluminum sheet with brazing substance on one side. The sheet is then stamped and formed into the two bracket members 40 and 41, preferably using a progressive die operation. The bracket members 40 and 41 are then fitted around the outside of the manifold 11 at the desired location, and positioned on the manifold with the protrusion 51 on the bracket member 40 engaging the corresponding detent or hole on the outside of the manifold. Then, the mechanical connection is made between the bracket members 40 and 41.

The remainder of the heat exchanger is the assembled in a conventional manner. The ends of the tubes 12 are inserted into the slots 21 of the manifold 11, and corrugated fins 13 may be sandwiched between the tubes. Suitable connections are attached to the manifolds 11 using the holes 22 provided for that purpose.

Other variations and modifications of the specific embodiments herein shown and described will be apparent to those skilled in the art, all within the intended spirit and scope of the invention. While the invention has been shown and described with respect to particular embodiments thereof, these are for the purpose of illustration rather than limitation. Accordingly, the patent is not to be limited in scope and effect to the specific embodiments herein shown and described nor in any other way that is inconsistent with the extent to which the progress in the art has been advanced by the invention.

What is claimed is:

1. A heat exchanger comprising:

a pair of manifolds, each of the manifolds having a plurality of axially spaced oblong slots;

a plurality of generally flat tubes extending between the manifolds and individually through the slots for providing fluid communication between the manifolds; and a plurality of radiation fins extending between adjacent flat tubes;

wherein at least one of the manifolds comprise a single formed rectangular sheet member having a seam formed from connection portions on each side edge of the sheet member, each of the side edge connection portions including an interlocking formation of tabs and recesses, at least some of the tabs deformed as the side edge connection portions engage each other in the circumferential direction.

2. A heat exchanger as defined in claim 1, wherein the interlocking mechanism includes positioning tabs on at least one side edge which do not deform and which engage corresponding positioning recesses on the opposite side edge.

3. A heat exchanger as defined in claim 1, wherein the recesses of the interlocking arrangement extend at an angle relative to the direction of the corresponding tabs prior to assembly of the manifold.

4. A heat exchanger as defined in claim 3, wherein the angle is between 5° and 45°.

5. A heat exchanger as defined in claim 1, wherein the interlocking formation extends longitudinally along the entire length of the manifold.

6. A heat exchanger comprising:

a pair of manifolds, each of the manifolds having a plurality of axially spaced oblong slots, each of manifolds having end caps positioned inside the manifold at each end;

a plurality of generally flat tubes extending between the manifolds and individually through the slots for providing fluid communication between the manifolds; and a plurality of radiation fins extending between adjacent flat tubes;

wherein the end caps include a concave portion exposed to the exterior of the manifold, the concave portions causing side rim portions of the end caps to move radially outwardly under pressure.

7. A heat exchanger as defined in claim 6, wherein at least one of the manifolds comprise a single formed rectangular sheet member having connection portions on each side edge, each of the side edge connection portions including an interlocking formation comprising tabs and recesses, at least some of the tabs deformed as the side.

8. A heat exchanger as defined in claim 6, wherein the end caps each include a groove extending circumferentially around the end cap adjacent to the manifold, and the manifold includes one or more crimps which fit into the groove to position and locate the end cap.

9. A heat exchanger as defined in claim 6, comprising in addition, a plurality of baffles located inside the manifold, each of the baffles including a groove extending circumferentially around the end cap adjacent to the manifold, and the manifold includes one or more crimps which fit into the groove to position and locate the end cap.

10. A heat exchanger comprising:

a pair of manifolds, each of the manifolds having a plurality of axially spaced oblong slots;

a plurality of generally flat tubes extending between the manifolds and individually through the slots for providing fluid communication between the manifolds;

a plurality of radiation fins extending between adjacent flat tubes; and a plurality of brackets for mounting the heat exchanger, each of the brackets comprising a first member and a second member mechanically secured to each other, each of the first member and the second member including a curved portion extending circumferentially around a portion the manifold and capturing the manifold therein.

11. A heat exchanger as defined in claim 10, wherein at least one of the manifolds comprises a single rectangular brazing sheet having connection portions on each side edge, each of the side edge connection portions including an interlocking formation comprising tabs and recesses, at least some of the tabs deformed as the side.

12. A heat exchanger as defined in claim 10, wherein the first member and the second member are mechanically secured to each other by providing tabs on the periphery of one of the members, the tabs being coined over the periphery of the other of the members to hold the members together.

13. A heat exchanger as defined in claim 10, wherein the first member and the second member are mechanically secured to each other by providing concentric holes in each member, each of the holes having a rim, the rim of one of the holes being coined over the rim of the other hole to hold the members together.

14. A heat exchanger as defined in claim 10, wherein one of the bracket members has a protrusion which fits into the manifold to locate and position the bracket.

15. A heat exchanger as defined in claim 10, wherein each of the bracket members has a curved portion which fits around the manifold, the curved portions of the bracket members together extending circumferentially around the manifold more than 180°.

16. A process of making a heat exchanger, comprising the steps of:

preparing a flat brazing sheet with an interlocking design along both sides;

forming the flat sheet into a tubular shaped manifold and connecting the interlocking design to each other in a generally circumferential direction;

piercing slots in the sheet;

providing a tube for each slot, and inserting the tube into the corresponding slot of the manifold;

placing fins between adjacent tubes; and brazing the manifold, tubes and fins together.

* * * * *